US006949686B2

(12) United States Patent
Kaminsky

(10) Patent No.: US 6,949,686 B2
(45) Date of Patent: Sep. 27, 2005

(54) PYROLYSIS GASOLINE STABILIZATION

(75) Inventor: Mark P. Kaminsky, Friendswoods, TX (US)

(73) Assignee: Equistar Chemicals, LP, Houston, TX (US)

( * ) Notice: Subject to any disclaimer, the term of this patent is extended or adjusted under 35 U.S.C. 154(b) by 426 days.

(21) Appl. No.: 10/158,322

(22) Filed: May 30, 2002

(65) Prior Publication Data

US 2003/0225305 A1 Dec. 4, 2003

(51) Int. Cl.[7] ..... C07C 5/03; C07C 5/09
(52) U.S. Cl. ..... 585/261; 585/262; 585/259
(58) Field of Search ..... 585/262, 261, 585/259

(56) References Cited

U.S. PATENT DOCUMENTS 4,404,124 A 9/1983 Johnson et al. ..... 252/466
6,204,218 B1 3/2001 Flick et al. ..... 502/243
2001/0001805 A1 * 5/2001 Brown et al. ..... 585/259

FOREIGN PATENT DOCUMENTS

EP 738540 A1 4/1996

OTHER PUBLICATIONS

Alvin B. Stiles, *Catalyst Manufacture Chemical Industries*, published by Marcel Dekker, 1983, vol. 14, pp. 3–13, 86–91, 103–107, and 129–131.
Paul Y. Hsieh, *Heats of Adsorption of Ammonia on Silica–Alumina Catalysts and Their Surface Energy Distributions*, Journal of Catalysis, vol. 2, 1963, pp. 211–222.

* cited by examiner

*Primary Examiner*—Thuan D Dang
(74) *Attorney, Agent, or Firm*—Roderick W. MacDonald

(57) ABSTRACT

A method for stabilizing pyrolysis gasoline by hydrogenating same over a Group VIII metal catalyst wherein the catalyst is promoted against poisoning by at least one metal from Groups I B, VI B, VII B, and zinc. Poisons preferentially bind with the promoters and not with the active catalytic metals.

13 Claims, No Drawings

PYROLYSIS GASOLINE STABILIZATION

BACKGROUND OF THE INVENTION

1. Field of the Invention

This invention relates to the stabilization of pyrolysis gasoline ("pygas"), and more particularly to the first stage hydrogenation of pygas.

2. Description of the Prior Art

Crude oil fractions such as a straight run naphtha from a crude oil still are conventionally steam cracked in an olefins unit to produce light olefins and aromatics, valuable chemicals in their own right. Pygas is a valuable by-product of such steam cracking because it is generally high octane and within the general gasoline boiling range of from about 100 to about 435° F., and can be used as a finished gasoline blending stream after undergoing certain processing before blending.

Because pygas is derived from steam cracking complex hydrocarbon streams such as naphthas, it can carry with it a large amount of widely varying catalyst poisons that interfere with the aforesaid pre-blending processing of pygas. The amount and severity of pygas poisons is unusually severe as compared to other gasoline producing streams, e.g., gasolines from catalytic cracking units. This makes pygas pre-blending processing quite detrimental to catalyst life during such processing.

Also unlike other gasoline streams used for finished gasoline blending, pygas, before first stage hydrotreating contains substantial amounts of gum precursors, and has poor oxidation stability.

Accordingly, pygas is challenging to stabilize and otherwise process before gasoline blending is undertaken.

The first stage of pygas processing before blending is often hydrotreating over a Group VIII metal catalyst (iron, cobalt, nickel, ruthenium, rhodium, palladium, osmium, iridium, and platinum) to selectively hydrogenate gum precursors such as diolefins, acetylenics, styrenics, dicyclopentadiene, and the like while not hydrogenating significant amounts of mono-olefins, aromatics, and other gasoline octane enhancers. Competitive adsorption causes diolefins and acetylenics to be hydrogenated preferentially over mono-olefins and aromatics thus removing gum tendencies while maintaining octane value. Paraffins are left unchanged or mildly isomerized which can help gasoline value.

Sometimes several stages of selective hydrogenation are carried out.

Second stage hydrotreating is often done on a BTX (benzene, toluene, and xylenes) fraction of pygas for removal of sulfur and other impurities.

The poison severity usually found in pygas can severely reduce first stage hydrogenation catalyst activity and catalyst life. For example, while sulfur, carbonyls, basic nitrogen, and gums/coking tend to be temporary catalyst poisons, arsenic, mercury, lead, and phosphorous tend to be more permanent poisons. Other permanent poisons include trace silicon oxide and corrosion metal oxide dusts which tend to plug catalyst pores. Also polysiloxanes thermally decompose and permanently poison palladium or nickel catalysts.

Guard beds can be employed upstream of a first stage hydrotreater to remove such poisons, but this is an expensive approach, and it is not always physically possible or otherwise practical to install guard beds and regeneration capability.

Thus, it is very desirable to have a pygas first stage hydrogenation catalyst that remains robust as to both selective hydrogenation activity and catalyst life when exposed to the pygas poison severity without resorting to a guard bed or other processing to remove or neutralize poisons before such first stage hydrotreating.

Group I B metals (gold, silver, and copper) have heretofore been used as a catalyst for the selective hydrogenation of unsaturates, see U.S. Pat. No. 5,068,477 to Berrbi. Berrbi's patent does not suggest directly or indirectly the use of promoters to make a pygas first stage hydrogenation Group VIII metal catalyst more robust to poisons carried in the pygas.

Group I B metals have also been suggested to be used with Group VIII metal on a support of silicon dioxide to remove alkynes, dienes and mono-olefins from olefin streams for polymerization over a metallocene catalyst or from pyrolysis gases produced in plastic recycling plants, see U.S. Pat. No. 6,204,218 to Flick et al. This patent also does not relate to the rendering of pygas hydrotreating catalyst more robust by the use of promoters.

European Patent No. EP O 738 540 Al to Zisman et at. discloses a method for the selective hydrogenation of acetylene in the gas phase using a catalyst containing alkali metal, chemically bound fluorine, and a support. Zisman et al. disclose that when the atomic ratio of fluorine to alkali metal is in (the range of 1.3:1 to 4:1 the catalyst is more resistant to deactivation to sulfur impurities. Zisman et al. optionally include silver in their catalyst but not as a promoter against sulfur poisons since Zisman et al. achieve their desired protection against sulfur deactivation when silver is not present in their catalyst.

U.S. Pat. No. 4,404,124 to Johnson et al. also discloses a method for the selective hydrogenation of acetylene in the gas phase using a catalyst containing palladium, silver, and alumina. Johnson et al. disclose that a high loading of the catalyst "is expected" to make the catalyst less sensitive to arsenic in the gaseous feed.

Thus, Zisman et al. and Johnson et al. 1) teach the use of silver as an active catalytic part of a catalyst for the selective hydrogenation of gaseous acetylene; 2) lead away from the use of silver as a promoter for sulfur poisons; and 3) only speculate as to the effect of silver high loading in respect of arsenic in the context of an acetylene selective hydrogenation catalyst. Further, neither of these patents suggest directly or indirectly the use of promoters to make a hydrogenation catalyst for normally liquid pygas more robust in the presence of the wide variety of poisons (which include sulfur poisons) normally found in a pygas feed.

DETAILED DESCRIPTION OF THE INVENTION

In accordance with this invention, conventional first stage pygas hydrotreating Group VIII metal catalyst is rendered more robust to the severity of poisons carried by pygas by employing said Group VIII metal on an alumina based support and adding to said catalyst at least one promoter selected from metals of Group I B (silver, gold, copper), zinc, Group VI B (chromium, molybdenum, tungsten), manganese, rhenium and/or oxides thereof. Presently preferred promoters are silver, gold, copper, and manganese in their reduced (elemental) state with the remainder of the materials being in an oxidized state. More preferred promoters include silver, gold, zinc, chromium, molybdenum, manganese, and copper. Of these preferred promoters, zinc, chromium, and molybdenum will be in the oxide form, and the others in the reduced state.

The promoter or combination of promoters is employed in an amount effective preferentially to trap at least one poison in said pygas and thereby separate same from said pygas before said poison reaches an active Group VIII metal site thereby leaving said Group VIII metal site active and available for said selective hydrogenation. Accordingly, the amount of promoter or promoters used can vary widely based on the amount, nature, and variety of poisons carried in the particular pygas being treated, but will generally be from about 0.01 to about 40, preferably from about 0.3 to about 15.0, weight percent based on the total weight of the catalyst.

The alumina based support of this invention is at least one of the group comprising alumina, deactivated alumina, amorphous silica-alumina, and crystalline silica aluminate. Silica by itself is not useful, contrary to Flick et al. cited hereinabove. Preferably all supports employed in this invention have slight or no acidity as measured by the conventional ammonia adsorption test, see *Journal of Catalysis,* Volume 2, pages 211–222, 1963. Still more preferably the support(s) has a Hammett function, $H_0$ in the range of −3.0 to 5.0 where $H_0=-\log[a_H{}^*f_B/f_{HB}]$. $a_H$ is defined as proton activity of the support and $f_B$, $f_{HB}$ are activity coefficients of the basic and acid forms of the support. The catalyst for the promoter can be employed on the surface of the support, in the interior pores of the support, or a combination of both.

Although some of the metals set forth above as promoters have been used as catalysts heretofore, they are not employed in a manner to serve as catalysts in this invention. Rather they are employed to serve as a promoter to maintain the Group VIII metal active to serve as the catalyst in the process of this invention. For example, when palladium is used in a catalyst according to this invention, it provides the active catalyst sites for the desired selective hydrogenation diolefins and acetylenics in the pygas. If silver was used as the promoter on a palladium catalyst, the silver would be many orders lower in activity as a catalyst than palladium or nickel and would serve primarily as a poison trap rather than as a catalyst. Similarly, if hydrogen sulfide ($H_2S$) is a prevalent poison in a particular pygas, zinc is an especially efficient $H_2S$ getter (adsorbent) and could, pursuant to the inventive concept of this invention, be employed as a promoter along with silver, or in lieu of silver, on, for example, a palladium/alumina catalyst used in the first stage hydrotreating of that particular pygas. Also, silver or gold promoted palladium is particularly selective for the hydrogenation of acetylinics to their corresponding olefin.

The catalyst of this invention can be made in any conventional manner well known in the art. One such preparation method is the well known "incipient wetness" process wherein, for example, a salt of the catalyst metal in an aqueous solution is applied on an alumina support form such as an extrudate. The catalyst metal impregnated wet extrudate is dried, leaving catalytically active metal on the extrudate. The dried catalyst is then calcined. The active metals in the catalyst need to be reduced to their metallic state and in the case of nickel be partially sulfided in order to get the catalyst into the desired state for use in the pygas hydrotreating/stabilizing operation. The support impregnation process can be repeated as desired to add additional catalyst metals or promoters to the support. The same process steps are used to add one or more promoters of this invention to the same support. For more information for the preparation of catalysts, see *Catalyst Manufacture, Chemical Industries,* Volume 14, published by Marcel Dekker (1983).

The feed material for this invention is any liquid phase pygas stream, whether full range or a fraction thereof, formed from any hydrocarbon steam cracking process. Such pygas feeds can have a wide variety of poisons and in varying amounts. Generally, they will have from about 30 ppb to about 500 ppm cumulative of a variety of catalyst poisons such as mercury, arsenic, lead, alkalai metal, phosphorus, silicon, iron oxide containing rouge dust (stainless steel corrosion products such as chromium oxide, nickel oxide and the like), sulfur, coke, halides (metal, particularly alkali and alkaline earth metal, chlorides, bromides and fluorides), siloxanes, sulfur containing compounds, nitrogen containing compounds, silica, carbonyls, and mixtures of two or more thereof. Mercury, arsenic, alkali metals, phosphorus, lead, iron oxide, sulfur, hydrogen sulfide, ammonia, and siloxanes are often present together in the same pygas fuel.

The particular combination of catalyst metal(s) and promoter(s) will vary widely as will the amounts of each employed on a single support depending on the hydrogenation selectivity desired and the variety and amount of poisons in the pygas feed. For example, palladium tends to be more selective for gum precursor hydrogenation and loses less octane in so doing, but it is quite vulnerable to poisons. It can be promoted with gold and/or silver to be more selective for acetylene hydrogenation and at the same time with zinc oxide if $H_2S$ is a particularly prevalent poison. The less acidic alumina supports of this invention reduce undesirable oligomerization reactions that lead to gums and coke fouling.

Also adding to the challenge of promoting the catalyst is that some of the poisons tend to be temporary while others tend to have a permanent poisoning effect. Temporary poisons include sulfur, carbonyls, and basic nitrogen. More permanent poisons include caustic, arsenic, mercury, lead, chlorides, phosphorous, transition metals from corrosion dust (Fe, Ni, Mn, Cr). Trace amounts of silicon as siloxanes from their use upstream as emulsion breakers can permanently poison palladium and nickel hydrogenation catalysts. Siloxanes (—O—Si($R_2$)—O—Si($R_2$)—O—), can be straight-chain or cyclic, e.g., hexamethylcyclotrisiloxane and octamethyl-cyclotetrasiloxane.

Also the tolerance of various catalyst metals to different poisons varies considerably. For example, in comparing a palladium based catalyst and a sulfided nickel based catalyst, the tolerances are (1) for siloxane, 500 ppm on 0.3 weight (wt.) % palladium versus several wt. % silicon on 12–18 wt. % NiS; (2) for arsenic and mercury, 6,000 ppm on 0.3 wt. % palladium to end of life versus 10 to 100 times more tolerance for nickel; (3) for $H_2S$, temporary poison for palladium but permanent for NiS; for basic nitrogen (ammonia), 1 to 100 ppm is a temporary poison to both palladium and NiS; and (4) phosphorus and sodium tend to be permanent poisons for both catalysts.

Accordingly, it is most difficult, if not impossible, to define the amount of each promoter used with a given catalyst for a particular pygas composition, but one skilled in the art and apprised of the inventive concept of this invention can readily determine which promoter or combination of promoters and in what amount for each promoter will appropriately protect against a particular set of poisons and amount of each poison in a specific pygas feed.

Accordingly, as can be seen from the foregoing, it is particularly difficult to determine how much of the cumulative amount of poisons in a given feed will be removed but in every case a significant reduction of cumulative poisons, e.g., at least about 10 wt. % and up to about 100 wt. % based on the total weight of the cumulative poisons, will be realized, and a lengthening of the active life of the catalyst will be realized.

The operating conditions of the method of this invention will, in view of the foregoing, vary widely as well, but will generally be from about 120 to about 450° F., at from about 100 to about 500 psig, and a weight hour space velocity (WHSV) feed rate of from about 1 to about 15 $h^{-1}$.

EXAMPLE

A full boiling range liquid pygas feed having about 40 wt. % $C_3$–$C_{10}$ hydrocarbons (saturates, olefins, and diolefins); about 54 wt. % of a mixture of benzene, ethylbenzene, toluene, and xylenes; and about 4 wt. % styrene, with the remainder being essentially $C_{11}$ and heavier hydrocarbons and containing about 100 ppm of a mixture of arsenic, mercury, sodium, phosphorus, organo-sulfur, $H_2S$, ammonia, and siloxanes is subjected to first stage hydrogenation/stabilization in a conventional liquid phase hydrotreater.

The hydrotreater carries a hydrogenation catalyst prepared by conventional incipient wetness procedures comprising an alumina support having a Hammett acidity indicator of less Ho of about −1.0. The support carries about 0.3 wt. % palladium based on the total weight of the catalyst. The catalyst also carries elemental silver, zinc oxide, and reduced manganese as a promoter package, said package being about 3.0 wt. % of the total weight of the catalyst. The silver/zinc oxide/manganese can be present in the promoter package in a range of ratios 0–100/0–100/0–100, respectively.

The pygas feed is passed through the foregoing reduced and otherwise activated catalyst at temperatures in the hydrotreater varying from about 150 to about 300° F. at a pressure of about 380 psig, at a WHSV of about 12 $h^{-1}$.

The pygas feed leaving the hydrotreater contains about 10% less of the foregoing poisons based on the total weight of the poisons, and the active catalyst life is significantly extended by at least 10% of what it would have been had no promoter package been employed.

Thus, in accordance with the inventive concept of this invention by employing a combination of a Group VIII catalyst on an alumina based support with at least one promoter as aforesaid, pygas can be selectively hydrogenated with improved tolerance to pygas poison severity.

What is claimed is:

1. In a method for stabilizing pyrolysis gasoline by the selective hydrogenation of diolefins and alkynes without substantial saturation of mono-olefins using a catalyst based on at least one Group VIII metal, the improvement comprising promoting said catalyst against at least one catalyst poison selected from the group consisting of mercury, lead, alkali metal, alkaline earth metal, phosohorus, silicon, iron, iron oxide containing rouge dust, coke, halides, nitrogen containing compounds, and silica, by employing with said catalyst a promoter which is selected from at least one material selected from the group consisting of zinc, metals of Group VI B, manganese, rhenium, and oxides thereof and supporting said catalyst on a porous alumina based support, said promoter being employed in an amount effective preferentially to trap and separate said at least one poison thereby leaving said Group VIII metal active for said selective hydrogenation, and thereby extending the active catalyst life.

2. The method of claim 1 wherein said poison is at least one of mercury, alkali metal, alkali metal halide, alkaline earth metal halide, phosphorus, lead, iron, ammonia, and coke.

3. The method of claim 2 wherein said poison is at least one of mercury, alkali metals, phosphorus, lead, iron oxide, and ammonia.

4. The method of claim 1 wherein said promoter is selected from the group consisting of zinc, chromium, molybdenum, manganese, and combinations of two or more thereof.

5. The method of claim 1 wherein said alumina based support is at least one material selected from the group consisting of alumina, deactivated alumina, amorphous silica-alumina, and crystalline silica aluminate.

6. The method of claim 1 wherein said manganese promoter is employed in the elemental state, and the remainder of said promoters are employed in an oxidized state.

7. The method of claim 4 wherein said manganese is employed in its elemental state, and said chromium, molybdenum and zinc are employed as oxides.

8. The method of claim 1 wherein said promoter is employed in an amount of from about 0.01 to about 10 weight percent based on the total weight of the catalyst.

9. The method of claim 1 wherein said poison in said pyrolysis gasoline is reduced by at least about 10 weight percent based on the total weight of said poisons.

10. The method of claim 1 wherein said catalyst and promoter are each employed on said support either on the surface of said support, in the pores of said support, or a combination thereof.

11. The method of claim 1 wherein said catalyst is palladium on alumina.

12. The method of claim 1 wherein said support has been treated to reduce its acidity.

13. The method of claim 1 wherein said stabilizing is carried out at a temperature of from about 120 to about 500° F., a pressure of from about 100 to about 500 psig, and a weight hourly space velocity of from about 0.1 to about 15 $h^{-1}$.

* * * * *